United States Patent [19]

Blok

[11] 4,087,921

[45] May 9, 1978

[54] MICROWAVE DRYING APPARATUS

[76] Inventor: Arie Blok, 1604 Dale Cir., N., Dunedin, Fla. 33528

[21] Appl. No.: 731,678

[22] Filed: Oct. 12, 1976

[51] Int. Cl.[2] ..... F26B 3/34; F26B 11/02

[52] U.S. Cl. ..... 34/1; 34/4; 34/136; 432/103; 432/106

[58] Field of Search ..... 34/1, 4, 135, 136, 137; 432/103, 106

[56] References Cited

U.S. PATENT DOCUMENTS

| | | | |
|---|---|---|---|
| 1,449,197 | 3/1923 | Russell | 432/103 |
| 1,756,821 | 4/1930 | Groen | 34/4 |
| 2,248,526 | 7/1941 | Francois | 34/4 |
| 2,341,101 | 2/1944 | Howard | 34/136 |
| 2,406,494 | 8/1946 | Ferris | 34/4 |
| 2,499,157 | 2/1950 | Peirce | 34/137 |
| 2,555,450 | 6/1951 | Lee | 34/1 |
| 3,337,965 | 8/1967 | Whitsel, Jr. | 34/135 |
| 3,528,179 | 9/1970 | Smith | 34/1 |
| 3,801,264 | 4/1974 | Lindl | 34/136 |
| 3,993,739 | 11/1976 | Vanderveen | 34/4 |

*Primary Examiner*—John J. Camby
*Attorney, Agent, or Firm*—John N. Randolph

[57] ABSTRACT

An apparatus for use in drying various kinds of finely divided materials utilizing microwave heating means for heating a rotating drum through which the material to be dried is drawn by suction. The apparatus includes means for separating the dried material from the air in which it is entrained during its travel through the drum.

8 Claims, 7 Drawing Figures

MICROWAVE DRYING APPARATUS

SUMMARY

It is a primary object of the present invention to provide a drying apparatus requiring no furnace or fuel storage facility.

Another object of the invention is to provide a drying unit utilizing microwave heating means enabling the temperature to be maintained below the combustion point, thereby avoiding the risk of fire.

A further object of the invention is to provide an apparatus through use of which heat loss can be substantially eliminated, thereby effecting a substantial energy saving.

Still another object of the invention is to provide a drying apparatus which is much lighter in weight than conventional drying units, due to the fact that a substantial part thereof can be constructed of non-metallic materials.

Various other objects and advantages of the invention will hereinafter become more fully apparent from the following description of the drawings, illustrating presently preferred embodiments thereof, and wherein:

DESCRIPTION OF THE PREFERRED EMBODIMENTS

Figures 1, 2, 3:
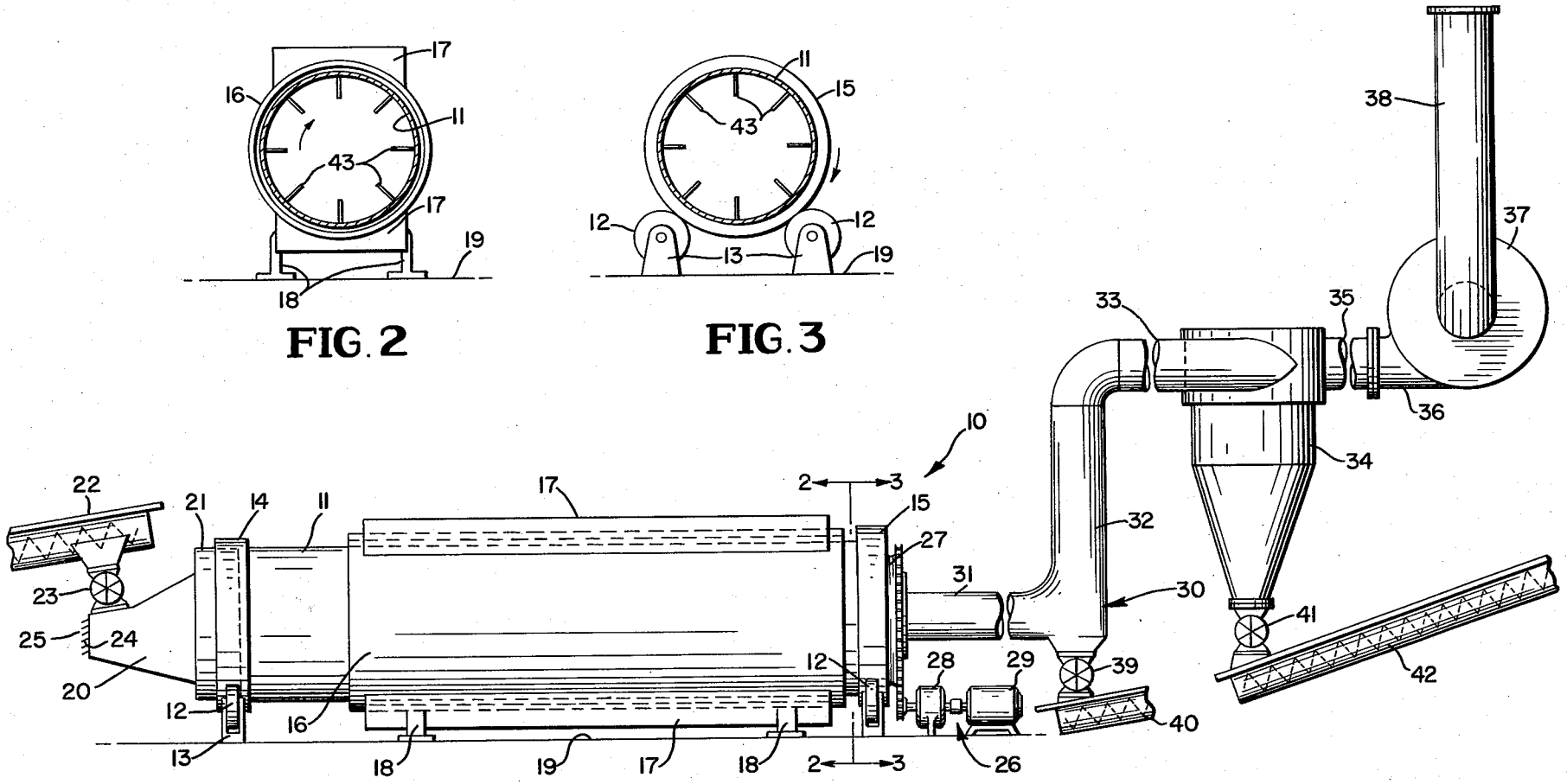
FIG. 1 is a side elevational view, partly broken away, illustrating a preferred embodiment of the microwave drying apparatus.
FIGS. 2 and 3 are cross sectional views, taken substantially along planes as indicated by the lines 2—2 and 3—3, respectively of FIG. 1.
Figure 4:
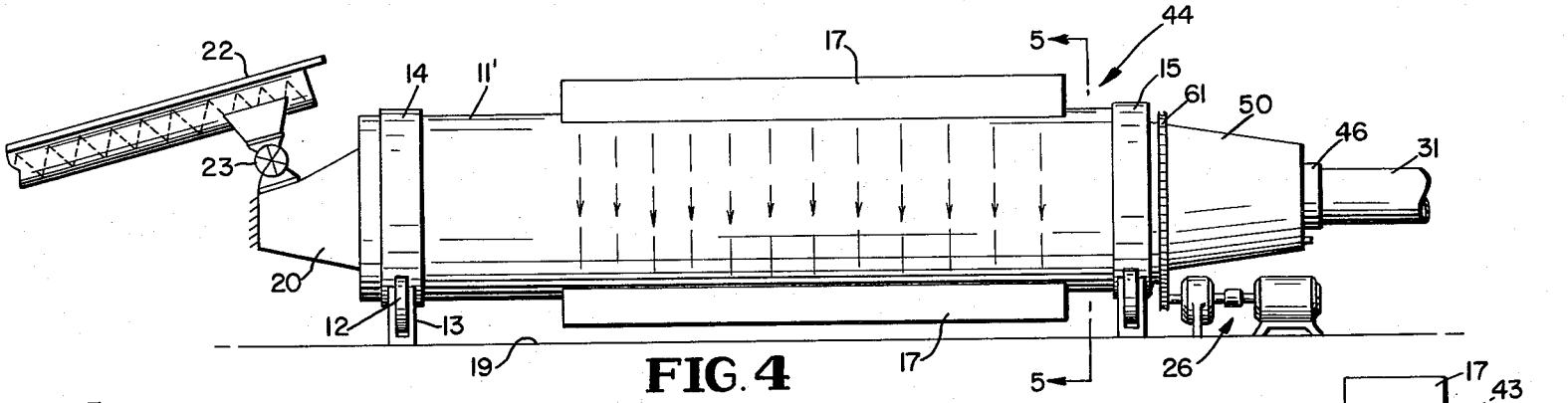
FIG. 4 is a fragmentary side elevational view of a modified embodiment of the drying apparatus.
Figure 5:
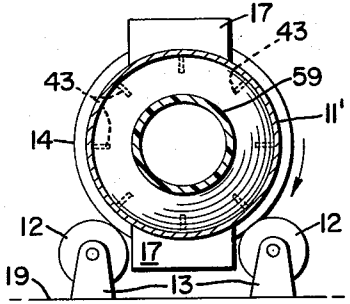
FIG. 5 is a cross sectional view thereof, taken substantially along a plane as indicated by the line 5—5 of FIG. 4.
Figure 7:
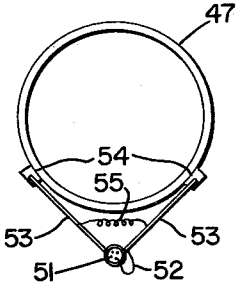
FIG. 7 is a detail view showing certain of the parts in end elevation which appear in side elevation in FIG. 6.

Referring more specifically to the drawings, and first with reference to FIGS. 1, 2 and 3, the drying apparatus as illustrated therein is designated generally 10 and includes an elongated drum or cylinder 11 which is rotatively supported at each end by a pair of rollers or wheels 12, each of which is rotatively mounted in a stationary upright fork 13, as best seen in FIG. 3. Collars 14 and 15 are secured to the ends of the drum 11 and provide annular surfaces which ride on the rollers 12.

A sleeve or cylinder 16 is disposed concentrically around and spaced from the drum 11 and has its ends disposed between and spaced from the collars 14 and 15. Two microwave heating units 17 are mounted externally on the cylinder 16. Support members 18 extend downwardly from a lower one of said units 17 and rest on a supporting surface 19, for supporting the cylinder 16 concentrically around the drum 11. A single microwave heating unit 17 could be utilized, or more than two such units could be employed.

A stationary inlet fitting 20 has an enlarged annular outlet end 21 which swivelly engages in the collar 14, by means of which the fitting 20 is supported. A feed screw conveyor 22 discharges above the fitting 20 into a conventional rotary airlock 23 from which the material, not shown, to be dried, is discharged into the fitting 20. The other restricted end of the fitting 20, which is disposed beyond the airlock 23, is open to provide an air inlet 24 which can be regulated by adjustably mounted louvers 25.

The drum 11 is preferably driven by a sprocket wheel and chain drive 26 including a large sprocket wheel 27 which is fixed to an end portion of the drum 11. The drive 26 preferably includes a reduction gear unit 28 which, like the drive motor 29 and forks 13, is supported on the surface 19.

A conduit 30 has an inlet end 31, constituting the outlet of the drum 11 and which extends into said drum through a central opening, not shown, of the sprocket wheel 27. The sprocket wheel 27 rotates around the stationary conduit end 31. The conduit 30 includes an upwardly extending intermediate portion 32 and an outlet end portion 33, which extends from the upper end of the portion 32 in a direction away from the inlet end 31.

Said outlet end 33 discharges into the inlet of a conventional cyclone separator 34 having an outlet 35 which connects with the inlet 36 of a centrifugal blower 37, which has a stack 38 extending upwardly therefrom and constituting the outlet thereof.

The lower end of the upright conduit portion 32 discharges into a rotary airlock 39 which discharges into a finished product material screw conveyor 40. The lower end of the cyclone separator 34 similarly discharges into a rotary airlock 41 which, in turn, discharges into another finished product material screw conveyor 42.

Suitable electrical conductors, not shown in FIGS. 1 to 3, lead from any suitable current source to supply electric current to the heating units 17, the rotary airlocks 23, 39 and 41, the screw conveyors 22, 40 and 42, the motor 29 and blower 37, all of which are simultaneously energized. The blower 37 creates a suction in the cyclone separator 34, conduit 30 and drum 11, for drawing air through the inlet 24 to entrain the material, not shown, to be dried, which is discharged into this air stream from the airlock 23, adjacent said inlet 24.

The drum 11 has baffles 43 which extend longitudinally thereof and which project radially inward from the inner surface of the drum, as seen in FIGS. 2 and 3, to cause a tumbling action of the material while passing through the drum, to enhance the drying effect produced by the microwave units 17. The dried material is discharged by suction from the rotating drum into the stationary conduit 30 where a part of the material separates from the air stream as it turns upward in the conduit portion 32. This separated part of the dried material falls into the rotary airlock 39 from which it is discharged onto the screw conveyor 40. The remainder of the dried material is discharged with the air stream into the cyclone separator 34 where it is separated from the air and falls onto the rotary airlock 42, from which it is discharged onto and carried off by the other conveyor 42. The remaining air passes through the blower 37 and is discharged from its stack 38. It will be understood that this constitutes a continuous operation as additional material to be dried is constantly being supplied to the inlet fitting 20 from the rotary airlock 23.

FIGS. 4 to 7 illustrate a slightly different embodiment of the microwave drying apparatus designated generally 44 and which includes all of the parts of the apparatus 10 except the cylinder 16 and support members 18.

Accordingly, the parts of the apparatus 44 bear the same reference numerals as the corresponding parts of the apparatus 10. The apparatus 44 differs from the apparatus 10 in that the microwave heating units 17 are secured directly to the drum 11' to rotate therewith.

The apparatus 44 includes a conduit 45 which is secured in and rotates with the drum 11' and which terminates adjacent the collar 15. The conduit 45 is composed of concentric tubes which are disposed in spaced apart relation to one another. The conduit 45, like the drum 11', is formed of plastic or other lightweight non-conductive material. A plurality of commutator rings 47 are mounted on the exterior of the conduit 45 to rotate therewith and are connected to the microwave units 17 by conductor wires 48 which lead from said rings into the space between the tubes of the conduit 45 through openings 49 in the outer one of said tubes.

Figure 6:
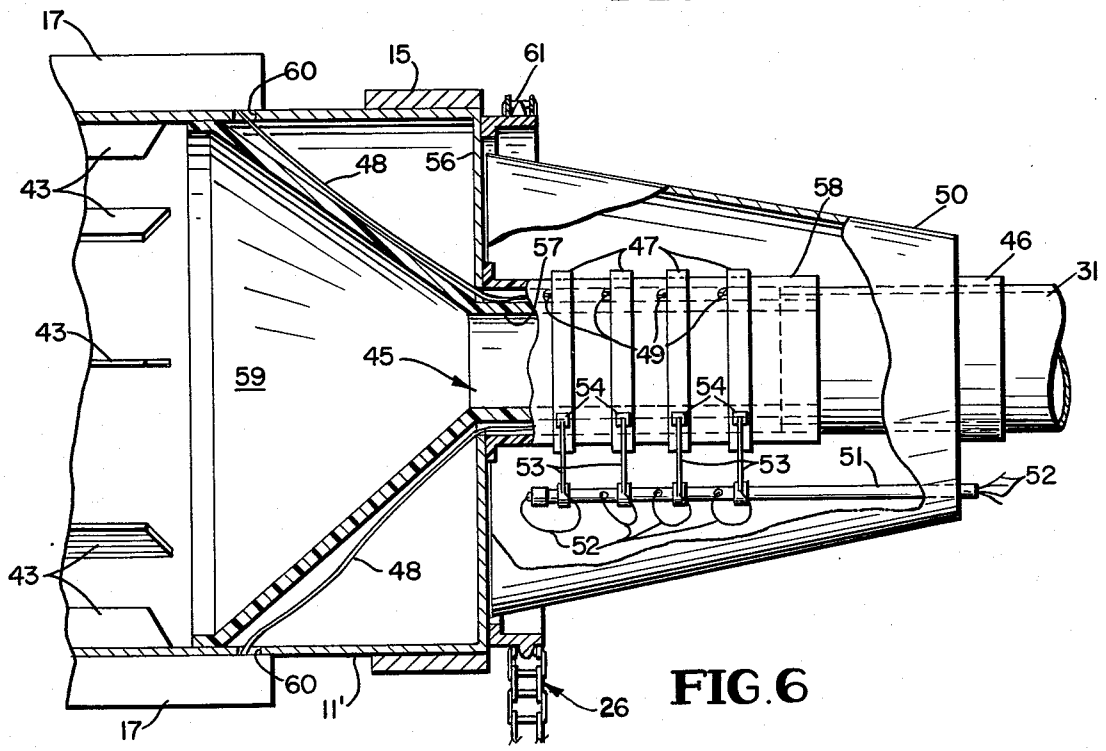
FIG. 6 is an enlarged fragmentary sectional view, partly in elevation, of a part of the apparatus of FIG. 4.

The conduit 45 and rings 47 are housed in a hood 50 of frusto-conical shape. An outer restricted end of the hood 50 is closed except for an annular flange 46 which receives the inlet conduit end 31 which extends therethrough and terminates in the annular space at the outer end of the conduit 45, as seen in FIG. 6. Thus, the conduit 31 supports the hood 50 which is stationary therewith, and provides a journal for the outer end of the conduit 45. Hood 50 provides a support for a stationary tube 51, one end of which extends through the restricted end of said hood to receive conductor wires 52 leading from a current source, not shown. Conductor wires 52 lead from portions of the tube 51, disposed within the hood, and connect with conductor arms 53 which are swingably mounted in pairs on the tube 51. The arms 53 carry carbon or brass brushes 54 at their free ends for engagement with the commutator rings 47. A pair of the brushes 54 engage each ring 47 and are held in contact therewith by contractile coiled springs 55, which extend between and are connected to the pair of arms supporting said brushes.

The drum 11' has an inturned flange 56 which surrounds and is spaced from the inner tube 57 of the conduit 45 and against which the outer tube 58 of said conduit abuts. Tube 57 has a flared or funnel-shaped inner end 59 which extends to and abuts against the inner surface of the drum 11', near to and spaced from the ends of the baffles 43 which are located near the drum end 56. Funnel 59 deflects the material, passing through the drum 11', into the inner tube 57. The conductor wires 48 lead through openings 60 in the drum 11' to the microwave units 17. Sprocket wheel 61, which replaces sprocket wheel 27, is ring-shaped and is secured to end wall 56.

The drying apparatus 44 functions in the same manner as the drying apparatus 10, as previously described, except that the microwave units 17 rotate with the drum 11.

Various other modifications and changes are contemplated and may be resorted to, without departing from the function or scope of the invention.

I claim as my invention:

1. A drying apparatus comprising an elongated drum, means rotatively supporting said drum, means imparting rotation to the drum, means for heating the drum, said drum having an inlet end and an outlet end, means creating a suction in said outlet end, said inlet end being open for admitting air to the drum, means discharging a material to be dried into the air stream adjacent said open inlet end, and means for separating the dried material from the air stream beyond said outlet end and between said outlet end and the suction means, said heating means comprising microwave units secured to the exterior of said drum and revolving therewith, said microwave units extending longitudinally of the drum and being circumferentially spaced from one another, and electric conductor means including rotatively moving commutator rings and non-rotating conductor brushes engaging said rings and forming parts of electric circuits for said microwave units.

2. A drying apparatus as in claim 1, said drum having internally disposed baffles causing a tumbling and agitation of the material passing therethrough to enhance the drying thereof.

3. A drying apparatus as in claim 1, said suction means comprising a blower, a conduit leading from the outlet end of the drum and connected to the inlet of the blower and provided with said means for separating the dried material from the air stream during its passage through said conduit.

4. A drying apparatus as in claim 3, said conduit having and upright portion provided with an open lower end, and said separating means including a rotary airlock connected to said conduit opening for removing the dried material from the conduit.

5. A drying apparatus as in claim 3, said separating means including a cyclone separator interposed in said conduit adjacent the blower and having an open lower end, and a rotary airlock connected to the open lower end of the cyclone separator for removing the separated dried material from the cyclone separator.

6. A drying apparatus as in claim 5, and conveyor means for carrying off the dried material discharged from said rotary airlock.

7. A drying apparatus comprising an elongated drum, means rotatively supporting said drum, means imparting rotation to the drum, means for heating the drum, said drum having an inlet end and an outlet end, means creating a suction in said outlet end, said inlet end being open for admitting air to the drum, means discharging a material to be dried into the air stream adjacent said open inlet end, and means for separating the dried material from the air stream beyond said outlet end and between said outlet end and the suction means, a stationary inlet fitting swivelly connected to said inlet end of the drum and having an end disposed remote from the drum and open to the atmosphere to provide the air inlet of the drum, a rotary airlock mounted on and rising from said fitting adjacent to the open inlet end, and a material conveyor discharging into said rotary airlock and through which the material is supplied to the inlet fitting to be entrained by the air being drawn therethrough.

8. A drying apparatus as in claim 7, a cylinder, means supporting said cylinder concentrically around the drum, and said heating means comprising microwave heating units supported by the cylinder in circumferentially spaced relation to one another.

* * * * *